United States Patent [19]

Wünning

[11] Patent Number: 4,582,301

[45] Date of Patent: Apr. 15, 1986

[54] PASS-THROUGH FURNACE FOR HEAT RECOVERY IN THE HEAT TREATMENT OF AGGREGATES OF METALLIC ARTICLES OR PARTS

[76] Inventor: Joachim Wünning, Bergstrasse 20, D-7251 Warmbronn, Fed. Rep. of Germany

[21] Appl. No.: 584,480

[22] Filed: Feb. 28, 1984

[30] Foreign Application Priority Data

Mar. 1, 1983 [DE] Fed. Rep. of Germany ..... 3307071

[51] Int. Cl.[4] ..... C21D 9/00

[52] U.S. Cl. ..... 266/87; 266/252; 266/259; 432/199

[58] Field of Search ..... 432/78, 199, 48, 164; 266/249, 251, 252, 254, 259, 87

[56] References Cited

U.S. PATENT DOCUMENTS

| | | | |
|---|---|---|---|
| 3,199,852 | 8/1965 | Koinis et al. | 266/254 |
| 3,782,931 | 1/1974 | Brede, III et al. | 266/251 |
| 4,093,195 | 6/1978 | Schwalm | 266/251 |
| 4,225,121 | 9/1980 | Meyer et al. | 266/130 |
| 4,457,493 | 7/1984 | Takahashi | 266/81 |

*Primary Examiner*—Christopher W. Brody
*Attorney, Agent, or Firm*—Frishauf, Holtz, Goodman & Woodward

[57] ABSTRACT

For recovery of heat, aggregates of metallic articles through which gas can flow are carried in a succession of baskets through a preheat zone, a treatment zone and a cooling zone of a heat treatment furnace and a heat transfer gas is constrained to flow vertically through the baskets in succession, beginning with the basket farthest advanced through the furnace, so far as concerns the basket in the cooling and preheat zone, the baskets having bottoms through which the gas can flow into or out of the aggregates. The heat transfer gas flows directly from the cooling zone. This may be done through the treatment zone where it may pick up additional heat. Heat may be removed from the heat transfer gas in a return circulation path outside the furnace. When the path of the basket is horizontal through the preheat and cooling zones, the flow of heat transfer gas is in transverse countercurrent to the advancement of the work, but if vertical transport of baskets is provided in the preheat and cooling zones, simple countercurrent operation can be provided with vertical flow through the baskets and aggregates. The ratio of heat capacity flow of the work to that of the heat transfer gas in the cooling and/or preheat zones is controlled to keep these heat capacity flows approximately equal and the preheat and cooling zones are so designed that the thermal exchange coefficient $\epsilon$ between the work and the heat transfer gas is consistently greater than 0.5.

10 Claims, 5 Drawing Figures

FIG. 2
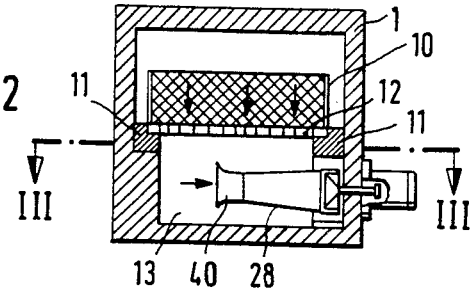
FIG. 3
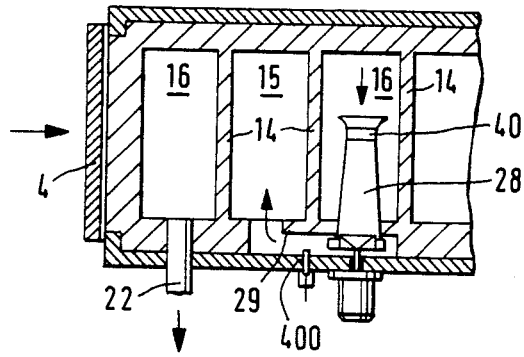
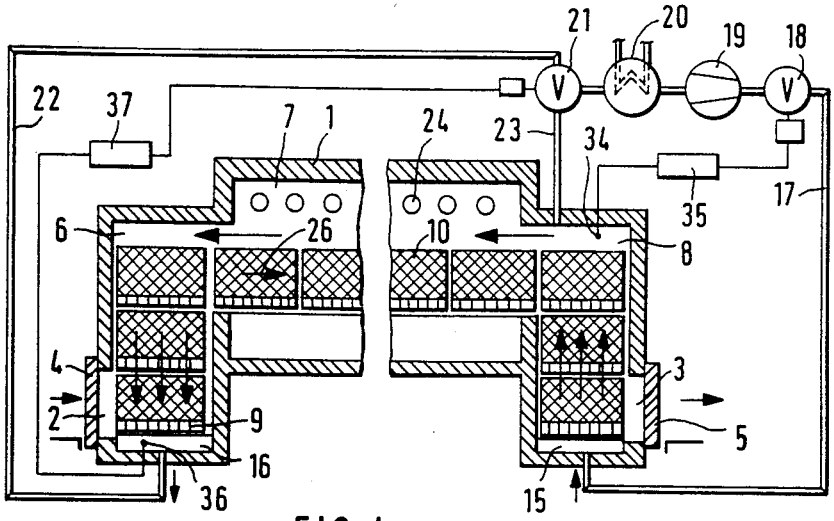
FIG. 4

PASS-THROUGH FURNACE FOR HEAT RECOVERY IN THE HEAT TREATMENT OF AGGREGATES OF METALLIC ARTICLES OR PARTS

This invention concerns a method, and appropriate apparatus therefor, for heat recovery in the heat treatment of metallic articles or parts which are advanced in aggregates contained in baskets through the preheat zone, heat treatment zone and cooling zone of a furnace, by the use of a flow of a gaseous heat transfer medium to carry heat out of the cooling zone into the preheat zone in countercurrent to the advancement of the aggregates of metallic parts or articles through the furnace. The apparatus of the invention also concerns equipment for controlling the throughput of a gaseous heat transfer medium respectively through the cooling zone and the preheat zone.

BACKGROUND AND PRIOR ART

The energy requirement for the heat treatment of metal parts made of steel and/or nonferrous metals is determined basically from two heat balance relations, provided that in the case of furnaces heated only by combustion of fuel the losses relating from the removal of the combustion products are disregarded:

*Energy requirement* $E$ = *useful heat flow* $Q_U$ + *wall heat flow* $Q_W$.

The wall heat flow $Q_U$ (wall losses) can be lowered by suitable furnace construction and installation. The useful heat flow $Q_N$ depends upon the throughput, the heat treatment temperature and the heat capacity of the useful material that is treated. Upon entry into the cooling zone the useful material has the temperature which prevails in the zone in which the material is held at the prescribed treatment temperature and that temperature is lowered in the cooling zone to ambient temperatures by heat removal. The heat there removed is usually lost, because up to now the equipment expense for recovery of heat involved in the heat treatment of metallic articles aggregated or stacked as they are moved through a furnace appeared to be substantially too large.

It is known in practice to provide separate preheating and cooling chambers associated with the furnace proper and to carry heat by means of a gas stream from the cooling to the preheating chamber, thus in countercurrent to the advancement of the useful material through the chambers of the furnace. In the case of pass-through furnaces, however, gas-tight doors are then necessary, by which the transport of the useful material is interrupted, thus making the overall operation of the furnace more difficult. Apart from the expense, such a division into separate individual chambers is quite impossible in certain furnace types (for example, furnaces incorporating a conveyor belt). There are also furnaces for treatment of metallic material which have a combined preheating and cooling zone in which heat transfer from the material to be cooled and to the material to be preheated is intended to be obtained by convention in the furace atmosphere which is uncontrolled as to its flow path. This uncontrolled gas convection, however, permits only a very incomplete heat recovery.

Finally, it is known from U.S. Pat. No. 4,093,195, in the case of a carburizing furnace having a heating zone, a carburizing zone and a diffusion zone, to provide at least one blower disposed at the furnace side wall below the grate in each of these zones for producing a gas flow through material to be cooled directed in transverse countercurrent. Each of these blowers, however, is limited to providing the corresponding supply of air to the particular zone with which it is associated; a uniform flow of gas through the high temperature material can be produced only in the particular zone. Heat recovery is not possible in this carburizing furnace, for use in preheating.

SUMMARY OF THE INVENTION

It is an object of the present invention to recover a substantial part of the useful heat $Q_U$ which would otherwise be simply removed from the cooling zone for heating of the useful material with simple adjustments of the operation to various operating circumstances (start-up, idle operation, change of throughput, etc.) and to accomplish that without the necessity of inordinately expensive apparatus.

Briefly, the gaseous heat transfer medium is constrained to flow, the cooling zone and in the preheat zone, in simple countercurrent or in transverse countercurrent or some combination thereof through the direction of advance of the useful material, the latter being advanced as batches of loose aggregates or as stacked material with interstitial space. The heat transfer gas is led from the cooling zone to the preheat zone directly and preferably by way of a valve-controlled pipe. The ratio of the heat capacity flow represented by the advancement of the useful material and the heat capacity flow of the heat transfer gas is controlled in the cooling and/or preheat zone in order to keep these respective heat capacity flows approximately equal. Furthermore, the cooling and preheat zone are provided with dimensions as to make the thermal exchange coefficient $\epsilon$ between the useful material and the heat transfer gas consistently greater than 0.5.

By constraining the heat transfer gas to flow either in simple countercurrent or in transverse countercurrent through the aggregates of useful material, a high proportion of the useful heat can be successfully transported from the cooling zone into the preheat zone. Supplementary heat is picked up by the heat transfer of gas when it flows through the treatment zone in order to be supplied to the preheat zone. The recovery efficiency is the greater the greater the heat exchange coefficient $\epsilon$ is. In practice, therefore, it is desirable to provide for having heat exchange coefficient values of at least 0.5 and preferably of the order of magnitude of $\epsilon = 0.7$ and greater.

The heat transfer gas can be supplied from the cooling zone directly through the treatment zone into the preheat zone. It is possible, however, to lead it, at least in part, through a pipe from the cooling zone to the preheat zone, an arrangement which makes it possible to push the principle of operation to perform with lower heat exchange coefficients or else to raise somewhat more the energy recovery.

Particularly in start-up, i.e. during the period in which heat cannot yet be recovered from the cooling zone, there is yet no recovered heat available for preheating of the useful material that is to be treated. It can therefore be advantageous to provide supplementary heating at least in certain periods for the useful material present in the preheat zone.

The heat transfer gas can be constrained to circulate in a circulation path containing the cooling and/or the preheat zone, a feature that is of particular significance a valuable gas, for example a noble gas such as argon or helium, is the heat transfer medium or a component thereof. In the case of such circulation the heat transfer gas is cooled at at least one place in the circulatory path preceding entry into the cooling zone of the furnace. The heat transfer gas flow can also be branched at its exit from the cooling zone in order to lead one part thereof in a circulation path directly back to the cooling zone.

The temperature of the heat transfer gas can be measured in the neighborhood of the transition between the cooling zone and the zone in which the treatment temperature is maintained in order to control by reference to this temperature the throughput of the heat transfer gas through the cooling zone. Instead of or in addition to that control, the temperature of the heat transfer gas in the neighborhood of its entry into the preheat zone can be measured in order to control, with reference to this temperature, the throughput of the heat transfer gas through the preheat zone.

The method of the present invention makes it possible to recover a large part of the useful heat flow, which would otherwise be uselessly led away from the cooling zone, without great apparatus expense. Practical experience with the method of the invention has shown that the recoverable portion as a rule amounts to more than 50% of the useful heat flow. At the same time, automatic adjustment of the parameters of the heat recovery operation to various operating conditions of the heat treatment is made possible.

The pass-through furnace provided by the invention for performance of the above-summarized method of the invention is distinguished by the fact that the preheat zone, the treatment zone and the cooling zone are disposed in direct connection to each other in the chamber of the furnace and by the fact that the cooling and preheat zones have channels for forcing the heat transfer gas to flow in an essentially vertical direction through the aggregates of useful material, either in simple countercurrent or in transverse countercurrent to the advancement of these aggregates in these zones, these channels being disposed below the transport containers for the aggregated which are permeable for the gas, the channels being closed off above by the gas-permeable baskets or similar batch carriers for the useful material, so as to constrain the gas to pass through the material in the prescribed pattern.

No doors need to be present in the furnace chamber between the preheat zone and the treatment zone or between the treatment zone and the cooling zone, so that the aggregates of the useful material can be transported through the furnace chamber without any hindrance. The channels present in the cooling and preheat zone for the heat transfer gas flow compel the necessary flow of the gas through the aggregates in countercurrent or transverse countercurrent, without any great apparatus expense being necessary therefor except for blowers. In one embodiment of the apparatus according to the invention the arrangement is so designed that the channels previously mentioned are bounded above by a support insert for the work batches on which the batch carriers abut each other essentially gas-tight, so that the gas is constrained to flow vertically throught the aggregates.

In order to direct the heat transfer gas in transverse countercurrent it is advantageous for at least one of the channels below the useful material to be subdivided into chambers in which at least one heat transfer gas feed blower produces oppositely directed vertical flow of the gas through useful material aggregates in adjacent batches. The blower can be disposed in the neighborhood of a partition between two chambers in the channel. In this manner it is possible by means of a single blower to produce respectively in the associated chambers a suction region and a pressure region below the work transport system, so that also in these regions adjacent work material aggregates receive gas flows in opposite directions. The blower can be provided with a measuring device for the heat transfer gas throughput which is associated with a cooperating positioning device, which if desired could be automatic, for heat transfer gas flow control, in order to set that flow at the appropriate value at the particular time.

In order to make possible direct leading of the heat transfer gas out of the cooling zone through the treatment zone into the preheat zone, passages for the heat transfer gas can be provided between the treatment zone and the cooling zone and likewise between the preheat zone and the treatment zone. The cooling zone and the preheat zone, however, can also be connected to each other by piping containing flow control means, if desired, and this pipe is preferably run through the treatment zone.

The heat transfer gas is arranged to flow through a return circulation path in which the gas exit at the work entry of the preheat zone and the gas entry at the work exit of the cooling zone are connect together by a valve controlled return line for the heat transfer gas, which return line contains a blower and a cooler. A valve controlled short-cut line can advantageously be branched from the return line over to the gas exit from the cooling zone in order to adjust the heat transfer throughput as may be required. Furthermore, the pass-through furnace can be provided with a supplementary heating apparatus, effective at least during start-up operation, in the region of the preheat zone.

Finally, the pass-through furnace can contain a temperature-measuring station at the input of the cooling zone and/or at the input of the heating zone and the measurement signals from the temperature measurement station or stations can be supplied to at least one controller which by acting on at least one flow control adjustment for the heat transfer medium will control the heat transfer medium flow through the cooling zone and/or the preheat zone at a predetermined desired value.

BRIEF DESCRIPTION OF THE DRAWINGS

The invention is further described by way of illustrative example with reference to the annexed drawings, in which:

FIG. 2 is a cross-section of the furnace of FIG. 1 along the line II—II of FIG. 1, likewise a schematic representation;

FIG. 3 shows a top view of a section along the line III—III of FIG. 2 of the input end of the pass-through furnace of FIG. 1, and FIG. 4 shows a sectional side view, comparable to that of FIG. 1, of another embodiment of pass-through furnace in accordance with the invention, likewise in schematic representation.

DESCRIPTION OF THE ILLUSTRATED EMBODIMENTS

Figure 1:
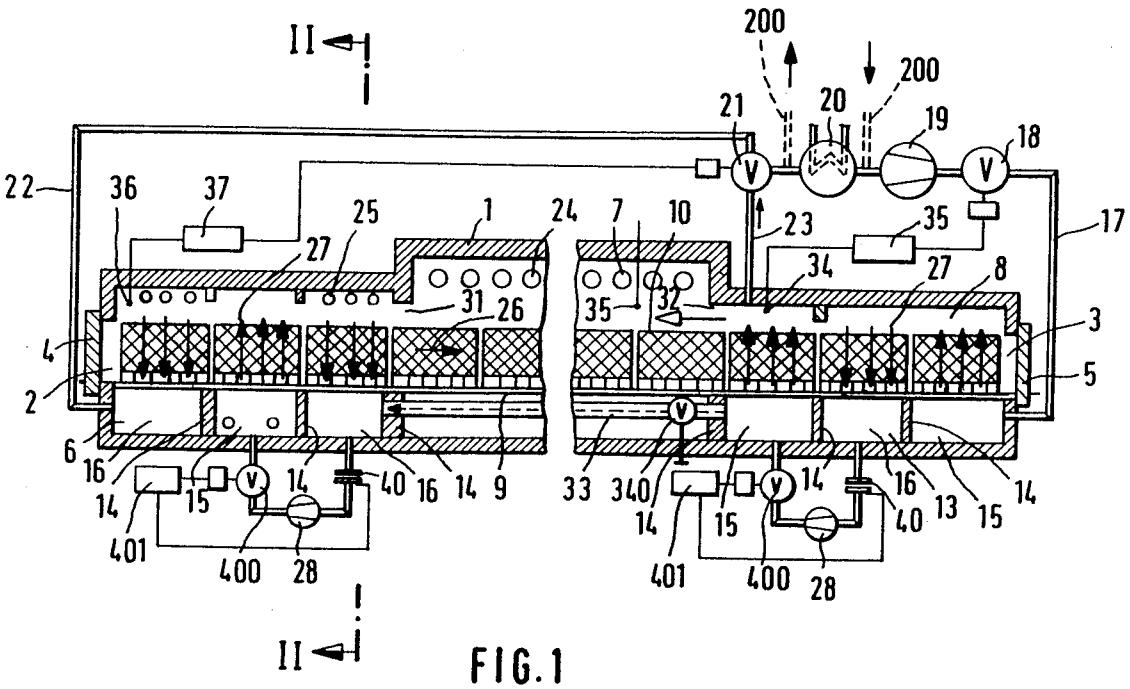
FIG. 1 shows a pass-through furnace according to the invention, in a schematic side view in a longitudinal section.

Two different embodiments of pass-through furnaces according to the invention are schematically shown in the drawings illustrating furnaces for heat treatment of metallic articles of steel or nonferrous metals which are treated in the form of loose aggregates of small parts or as stacked articles.

In each case the furnace has an elongated furnace chamber 1 built of heat-insulating material having an input opening 2 and an output delivery opening 3 both of which are closed off, respectively by doors 4 and 5, except when a batch of articles is being loaded in or delivered out.

The furnace chamber 1 includes a preheat zone 6, a heating or treatment zone 7 directly connected with the preheat zone and, finally, connecting with the other end of the heating or treatment zone, a cooling zone 8. No doors are provided between the zones 6 and 7 or between the zones 7 and 8, so that a direct connection with each other exists between the successive furnace chamber parts.

A gas permeable transport device 9, for example, a gaspermeable conveyor belt, roller hearth or bumping table, extends right through all of the preheat zone, the treatment zone and the cooling zone 8. Loading baskets 10 each having a bottom through which gas may pass, are successively put onto the transport device 9 through the input opening 2, while loading baskets are taken out in the same rhythm at the delivery opening 3. In this way the batches of material to be treated contained in the loading baskets 10 are successively transported through the preheating zone 6, the treatment zone 7 and the cooling zone 8. The side walls of the loading basket 10 are impermeable to gas.

The illustrated transport means 9 comprises a pair of loading basket guide-supports 11 supported on or near the two opposite sides of the furnace chamber 1. The loading baskets 10 are pushed along the path defined by the guides 11 in abutment one behind the other.

As already mentioned, each loading basket 10 is equipped with a gas-permeable bottom 12. The loading basket supporting guides 11 and the loading baskets supported thereon in close abutment to each other seal off a channel 13 disposed below the latter which extends along the entire length of the internal space of the furnace chamber 1, but is closed off by transverse walls 14 at the ends of the treatment zone 7. Beyond the ends of the treatment zone 7 the channel 13 is subdivided into chambers 15,16.

As shown in FIG. 3 the chambers 15,16 are dimensioned to correspond with the size of the loading baskets 10, so that the stationary positions of the intermittently advanced loading baskets 10 in the preheat and cooling zones 6 and 8 are above respective chambers 15,16. In the neighborhood of the exit from the cooling zone 8 a supply pipe 17 is connected to the chamber 15 at that location for supply of a gaseous heat transfer medium. The line 17 contains a control valve 18, a blower 19 and a cooler 20. It is connected through to three-path control valve 21 and, together with a line 22 leading away from the furnace chamber in the neighborhood of the input to the preheat zone 6, provides a return flow line for the heat transfer medium. One branch line from the three-path control valve 21 is the branch line 23 which connects to the interior of the furnace chamber 1 in the neighborhood of the entrance into the cooling zone 8. Air, waste gas or protective gas or the like can be used at the gaseous heat transfer medium. The furnace chamber 1 is heated in the neighborhood of the treatment zone 7 by a heating system schematically shown and designated 24. Supplementary heating 25 is provided, in addition, in the region of the preheat zone 6, the task of which will be further explained below.

The heat transfer medium flowing into the cooling zone 8 over the line 17 is compelled in the manner shown by arrows in FIG. 1, to flow through the aggregated material contained in the loading baskets 10 in transverse countercurrent with reference to the direction of movement of the aforesaid material designated by an arrow 26, as shown at 27. For this purpose a blower 28 is disposed between each neighboring pair of chambers 15,16. The blowers 28 are so disposed in a lateral partition 29 that one —15— of the chambers 15,16 is put under pressure while the other of the pair is subjected to negative pressure (suction) so that the articles in the corresponding neighboring loading baskets are flushed by gas in opposite directions.

As a result of this flow through the aggregated material in the baskets the heat transfer medium picks up a substantial portion of the useful heat contained in the material while located in the cooling zone 8. Thereafter the heat transfer medium is immediately led to the preheat zone 6, where it is compelled in a corresponding manner to flow through the aggregated material contained in the loading baskets, again in a transverse countercurrent 27, until the heat transfer medium now cooled down, exits from the preheat zone 6 through the line 22 and is put back into circulation by the supply line 17.

The preheat zone 6 and the cooling zone 8 are of such dimensions that the ratio of the heat capacity flows respectively of the useful articles and the heat transport gas, in continuous operation, is equal to about 1.

The so-called degree of thermal exchange, designated $\epsilon$ in the preheat and cooling zones depends upon the aggregate surface F, the heat transfer coefficient $\alpha$, the heat capacity current C and the number of successive passes of the flow (compare, for example, VDI Heat Atlas, VDI Verlag, Düsseldorf). The preheat zone 6, the cooling zone 8 and the heat carrier throughput in these zones are so designed for the highest possible value of heat exchange factor $\epsilon$, which in any case is greater than 0.5 and preferably greater than 0.7.

Under these circumstances the heat exchange medium heated up in the cooling zone 8 in the manner described can be allowed to flow directly into the preheat zone 6 through passages 31 and 32 through the treatment zone 7, a feature that results in a particularly simple construction of the heat exchange system of the furnace.

In the channel 13 beneath the guides 11 of the transport system 9 still another line 33 is provided which contains an adjustable valve 340 and produces a direct connection running through the furnace chamber between the cooling zone 8 and the preheat zone 6. This tubular line 33 makes it possible to lead the heat exchange medium, in whole or in part, from the cooling zone 8 into the preheat zone 6 even when the thermal efficiency $\epsilon$ is low. Furthermore, by means of the tubular line 33 the energy recovery can be raised somewhat.

If a protective gas (an inert gas, for example) is the heat exchange medium, it is circulated over the lines 22 and 17 by the blower 19 in a closed circuit in the manner already described, while the cooler 20 makes it possible to cool the heat exchange medium to the desired temperature. The sluices necessary for operation with expensive protective gas, which would be located in the neighborhood of the input and output openings 2,3, are not specifically shown in the drawings.

If the heat treatment of the aggregated material takes place without protective gas, for example in the presence of air as a heat exchange medium, the circulation path is opened at 200, at the location of the cooler 20, so that the cooler 20 is cut out of the circulation path and may be removed (i.e. used air is discharged and fresh air taken in).

The cooling zone 8 contains a temperature sensor 34 in the neighborhood of its inlet. The sensor 34 provides signals that are supplied to a controller 35 that operates the control valve 18 and thereby controls the heat exchange medium flow in the cooling zone 8 in a manner dependent on the temperature which is found at the transition between the cooling zone 8 and the treatment zone 7.

When the ratio of the heat capacity flow from the material under treatment and the heat exchange medium is equal to 1 in the cooling zone 8, the difference between the temperature measured at 34 and the temperature measured at 35 in the treatment zone 7 is equal to the difference between the heat exchange medium inflow temperature where the line 17 is connected to the channel 13 and the temperature of the material under treatment when it comes out of the delivery opening 3. For sufficient constancy of these three temperatures the temperature measured at 34 can be used directly as a control magnitude.

Another temperature measurement location is provided at 36 at entrance of the preheat zone 6. The temperature sensor located at this place controls the heat exchange gas flow through the preheat zone 6, operating through a controller 37 and the three-path control valve 21. In continuous operation the heat exchange medium flows entirely or in large part through the preheat zone 6, whereas with declining throughput or in idle operation the heat exchange medium is guided in whole or in part through the short-cut line 23 and through the cooler 20 in which it is brought down to the desired temperature.

In starting up of the pass-through furnace the heat exchange medium flow is blocked by the controller 35 operating through the control valve 18, because there is as yet no heated up material in the cooling zone 8. Since the heater 24 of the treatment zone 7 in this case is not sufficient for the nominal throughput, a supplementary heater 25 is provided in the preheat zone 6 which can then go into action.

The transverse countercurrent 27 in the cooling zone 8 and in the preheat zone 6 makes at least two passages through the aggregated material contained in the loading baskets 10 in each zone. As already explained, in every case, for one passage affected by the gas propelled into the material there is also another passage performed by suction, each of the blowers 28 providing two passes through the aggregated material.

As can be seen from FIGS. 1 and 3 a suction-side Venturi measuring nozzle 40 is provided at each blower 28, by which the flow of heat transfer medium can be monitored and signals produced which make it possible to set the heat capacity flow ratio of 1 between the flow of material under treatment through the furnace on the one hand and the heat transfer medium flow on the other hand, the setting being formed by means of the gate valve 400 controlled by positioning motors 401.

In the embodiment of the invention shown in FIGS. 1, 2 and 3 and above-described, the heat transfer gas is caused to flow in transverse countercurrent to the direction of transport of the material being treated, both in the preheat zone 6 and in the cooling zone 8. The expression "transverse countercurrent" means that the heat transfer gas flows transversely to the direction of advance of the material treated by the furnace, but does so in successive passes which are progressively nearer the end of the furnace for which the material to be treated starts its journey through the furnace. The invention is also applicable to other schemes of construction of pass-through furnaces for heat treatment, in which the aggregate of metallic material heat-processed by the furnace is subjected to a permeating flow of heat transfer gas in the preheat zone 6 and in the cooling zone 8 which is directed strictly in countercurrent to the intermittent motion of advance of the material which is being treated in the treatment zone 7. An embodiment of the invention of that latter type is illustrated in FIG. 4.

In FIG. 4 parts which are essentially the same as those of FIG. 1 are given the same reference numerals in order to make clear that a repeated description or explanation thereof is, to that extent, superfluous.

In the embodiment of FIG. 4 the loading baskets 10 which transport the material to be heat treated through the heat treatment zone 7, where they are advanced horizontally as in the case of FIG. 1, are advanced vertically in the preheat zone 7 and in the cooling zone 8 by the transport system 9', moving upwards in the preheat zone to reach the higher level of the treatment zone portion of the set furnace and moving downward in the cooling zone 8. Since the loading baskets 10 allow gas to flow through their respective bottoms and are open at the top, the heat transfer gas can flow through them in direct countercurrent to their upward and downwrd intermittent movement. Furthermore, the blowers 28 of FIGS. 1–3 can be dispensed with. On the other hand, additional expenses involved in replacing the simple horizontal pushing of the line of baskets 10 in FIG. 1 every time a newly loaded basket it pushed into the entrance 2, causing a treated and cooled load to be pushed out in its basket at the exit 3, with a more complicated transport system 9', where first a basket 10 must be pushed or drawn horizontally out through the exit door 5 to vacate a space into which a column of baskets can move downward by one basket, in turn vacating a space into which a row of baskets can be pushed by one basket dimension, which movement then vacates a space into which a column of baskets may be lifted by one basket height so as to permit insertion of a freshly loaded basket through the entrance door 4. Of course, a system equivalent to the system of FIG. 4, likewise with vertical movement of baskets in the preheat zone and the cooling zone 8 can operate with downward movement of baskets in the preheat zone and upward movement of baskets in the cooling zone. Finally, it is not necessary for the entrance door 4 and the exit door 5 to be at the same level nor, indeed, for the path of the basket in the preheat zone and in the cooling zone through which the baskets are advanced to be of the same length. In fact, the baskets could be moved upwards both in the preheat zone 6 and in the cooling zone 8, or downwards in both of these zones, for obtaining the advantage of direct countercurrent flow of the heat carrier gas, if it should be convenient to have the baskets enter near the bottom level of the furnace and exit near the top level of the furnace, or vice versa.

Systems for providing the vertical transport in any of the above-described versions of the transport system 9' of FIG. 4 and the combination of that vertical transport with the horizontal transport through the treatment zone 7 are known and available in the art, whether functioning by transmission of force through the baskets from one to the next or by using ladder conveyors. Force can be transmitted through the baskets by a piston operating at the bottom of each vertical column, the systems cooperating, in the case of the upward movement, with a retaining slide inserted to hold the column when the piston is lowered to accept another basket for the next upward movement.

Figure 5:
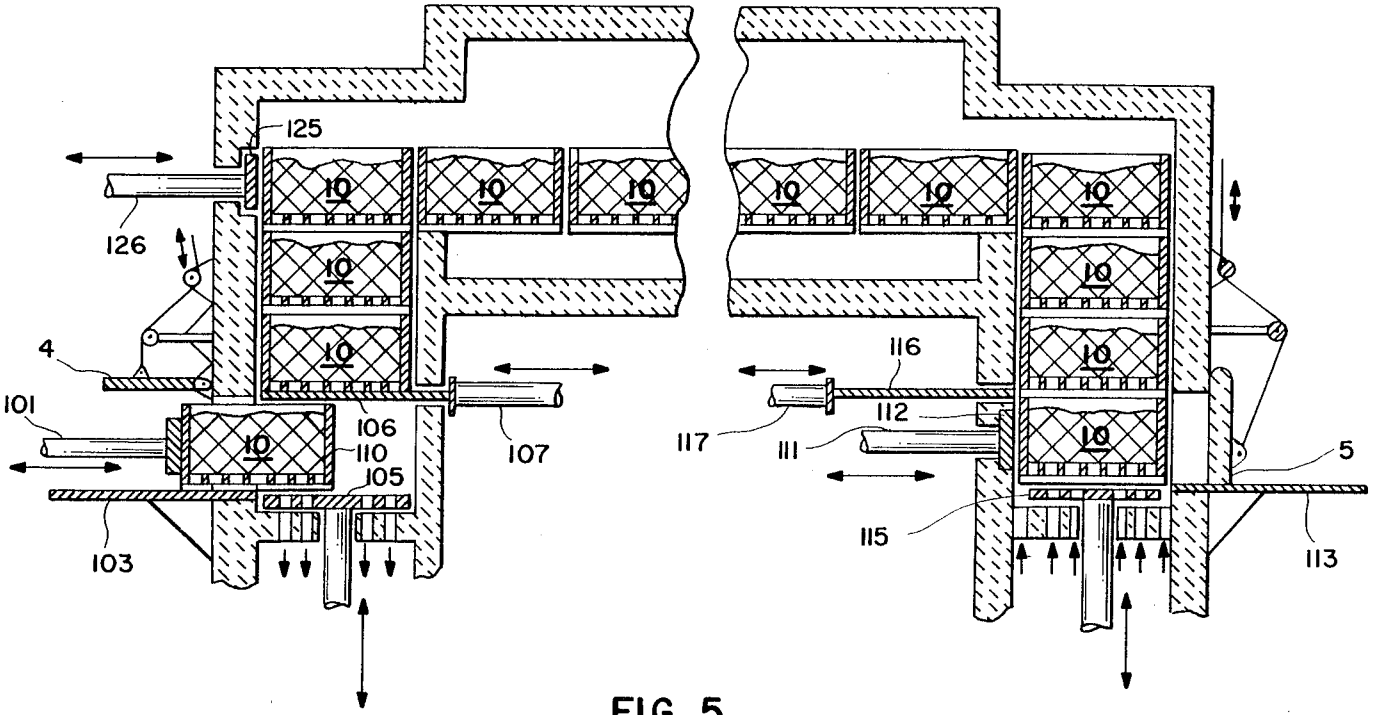
FIG. 5 is a diagram of a mechanical system for advancing transport baskets through the furnace of FIG. 4, viewed in the same aspect as FIG. 4.

A schematic diagram of such a piston-control scheme for intermittent advancement of the baskets for the embodiment of the invention shown in FIG. 4 is illustrated in FIG. 5.

In FIG. 5 a basket 110 is being advanced through the entrance door 4, in this case by a pusher rod 101 which may be manually or otherwise (for example, hydraulically) operated. The door 4 has been raised by a cable 102 to admit the basket 110 from the loading apron 103. When the insertion of the basket 110 is complete, the basket will be seated on the piston 105 and, of course, the insertion of the basket 110 at the bottom of a vertical stack of baskets 10 is made possible by the support of the three baskets thereabove temporarily on the sliding platform or grid 106 inserted for that purpose by the shaft 107. When the basket 110 is finally in place, the shaft 101 will be withdrawn, the door 4 dropped back in place and the plate or rods 106 withdrawn from between the basket 110 and the basket 10 lying directly above it. That will complete a previously begun advancement step. The next advancement step will begin by raising the door 5 inserting the plate or grid support 116 by means of the shaft 117 to support the baskets 10 located above the basket 210, then pushing the basket 210 out of the furnace onto the delivery apron 113 by force applied through the piston 119 and the shaft 111. The shaft 111 and the piston 119 will then be withdrawn, so that the piston 115 can be raised high enough to support the baskets 10 thereabove in the positions shown in the drawing, so that the slide 116 can be removed by the shaft 117. When the latter operation is done, the piston 115 will be lowered and along with it the baskets 10 supported thereby, making a space into which the horizontal row of baskets 10 can be advanced by means of the piston 125 actuated by the shaft 126. After that the piston 125 will be retracted to the position shown in the drawing and the piston 105 will raise the stack of baskets by the height of one basket and the slide 106 will be inserted by the shaft 107 where after which the piston 105 will be lowered and the insertion of a new basket will proceed in a manner already described. The entire advance sequence can be operated hydraulically.

When direct gas heating is provided by the heating system 24 into the furnace shown in FIG. 4, the combustion product mix with the heat transfer gas and are cooled in the preheat zone 6, serving also to preheat the materials being advanced through the preheat zone 6.

The operation of a furnace in accordance with the method of the invention is illustrated by the following specific example.

EXAMPLE

Cold-shaped steel parts loosely aggregated in basket containers were heat treated by calcination in which they were held for one hour at 700° C. The average steel part dimension was 40 mm, the aggregate density was 3000 kg/m$^3$ and the specific surface of the parts was 0.02 m$^2$/kg.

Intermittent advance by pushing or bumping after the manner of FIG. 1 was performed at 30 minute intervals. Gross load was 100 kg/h, heat capacity flow of the treated material was 170 W per degree Kelvin. The basket dimensions L×W×H were 0.5×1.0×0.3 m, gross load weight 500 kg, and surface per basket load with which the furnace was charged, 10 m$^2$.

Nitrogen was used as the heat transfer medium at a flow rate of 615 kg/h referred to 170/°K., mass flow density through the steel parts aggregate being 0.35 kg/m$^2$s.

For the separate zones 6,7 and 8:

Preheat zone 6: Three loaded baskets with 30 m$^2$ of surface, thermal exchange coefficient $\epsilon=0.75$. Transverse countercurrent with three passes. Heating from 20° to 530° C. of the aggregate. Heat transfer medium cooling from 700° to 190° C.

Treatment zone 7: Four basket loads (two for residual heating up). Heating from 530° to 700° C. of the aggregates.

Heat transfer medium heating from 535° to 700° C. (Heat transfer medium proceeding directly through the treatment zone).

Cooling zone 8: Three basket loads with 30 m$^2$, $\epsilon=0.75$ Transverse countercurrent with three passes. Cooling from 700° to 200° C. of the aggregate. Heat transfer medium heating from 35° to 535° C.

| Energy Consumption | Useful Heat (kW) | Small Losses (kW) | Total |
|---|---|---|---|
| Without heat recovery | 115.6 | 15 | 130.6 |
| With heat recovery | 57.0 | 15 | 72.0 |

That means:

Heat energy saving of 45% with heat recovery

Cooling water saving of 75% with heat recovery

Comparable investment cost, because the cost for the heat transfer medium circulation and the blowers was compensated by the equipment investment involved for providing the greater heating in furnaces without heat compensation.

Although the invention has been described with reference to two particular methods of countercurrent heat recovery and one particular example of operating conditions, it will be recognized that modifications and variations are possible within the inventive concept. For instance, features of FIGS. 1, 2 and 3 can be adapted to the system of FIGS. 4 and 5 and vice-versa. Again, the gas flow can be simple countercurrent (FIG. 6) in the cooling zone and transverse countercurrent in the preheat zone, or vice-versa.

I claim:

1. Pass-through furnace for heat treatment of metallic articles or parts comprising:

a furance chamber having adjacent preheat, treatment and cooling zones interconnected so as to permit passage of said articles or parts through said zones in direct succession, said preheat zone having a work input region and said cooling zone having a work output region, said furnace chamber also having a flow path (S31, 32; 33) through said treatment zone (7) for heat-transferring gas, which path connects said preheat (6) and cooling (8) zones for said gas;

means for transport successively through said preheat, treatment and cooling zones of said articles or parts, in batches in the form of aggregates permitting interstitial passage of gas therethrough, said transport means being consituted so as to permit flow of gas vertically through said aggregates and being further constituted to advance said aggregates intermittently through said said zones in steps of at least one entire batch space, said transport means including batch carriers for said articles or parts having bottom partitions provided with apertures for flow of gas therethrough and having end portions fitting substantially gastight in abutment with an end portion of another one of said batch carriers, and means for producing and directing a flow of heat transferring gas through said cooling zone, said flow path of said chamber connecting said cooling and preheat zone and said preheat zone of said furance chamber in succession and for constraining said gas to flow vertically through said aggregates in said cooling and preheat zones in transverse countercurrent to the advancement of said aggregates through said zones, said gas flow producing and directing means including channels provided below said transport means for for providing access and removal of said gas through and from said aggregates through portions of said transport means which are contituted so as to enable passage of gas therethrough, said channels being closed off at the top by the apertured bottoms of said batch carriers disposed in close abutment to each other for constraining gas to flow vertically through said batch carriers and their contents, and including also a valve-controlled return line (22,17) having a blower (19) interposed therein for causing flow of said gas coming out from the work input region of said preheat zone (6) through said return line and into the work output region of said cooling zone (8).

2. Furnace according to claim 1 in which at least one of said channels is subsdivided into chambers and at least one blower (28) is interposed between adjacent ones (15, 16) of said chambers for producing oppositely directed flow through aggregates of articles or parts respectively located in adjacent batch carriers.

3. Furnace according to claim 2 in which said at least one blower is equipped with means (40) for measuring the throughput of said gas and with a control for adjusting the throughput of said gas through said at least one blower.

4. Furance according to claim 1 in which said flow path of said chamber connecting said cooling and preheat zones includes passages (31, 32) for said heat-transferring gas respectively from said cooling zone to said treatment zone and from said treatment zone to said preheat zone, whereby at least a portion of said gas is caused to pass through said treatment zone.

5. Furnace according to claim 1 in which piping (33), having interposed flow control means (340) for at least part of the flow of said heat-transferring gas from said cooling zone (8) to said preheat zone (6), is provided for containedly conveying said gas through said treatment zone (7).

6. Furnace according to claim 1 in which a valve controlled short-cut line (23) branches off from said return line (22,17) tp connect with the heat-transferring gas exit from said cooling zone (8).

7. Furnace according to claim 1 in which supplementary heating means (25) are provided in the region of said pre;heat zone (6) for operation at least during start-up of operation of said furnace.

8. Furnace according to claim 1 in which temperature of measurement means (34) are provided in the work entrance region of said cooling zone (8) and means (35) responsive thereto are provided for controlling the throughput of said heat-transferring gas through said cooling zone for obtaining a desired value of said throughput.

9. Furnace according to claim 1 in which temperature of measurement means (36) are provided in the work entrance region of said preheat zone and means (37) responsive thereto are provided for control of the throughput of said heat transferring gas through said preheat zone for obtaining a desired value of said throughput.

10. Furnace according to claim 1 in which said return line (17, 22) is provided with loop extension branches (200) usable for making possible processing of said medium at another location by connecting lines.

* * * * *